US009453384B2

(12) United States Patent
Von Wirth et al.

(10) Patent No.: US 9,453,384 B2
(45) Date of Patent: Sep. 27, 2016

(54) METHOD AND DEVICE FOR SEPARATING PIPES

(75) Inventors: Hermann Josef Von Wirth, Titz (DE); Torsten Kleinen, Erkelenz (DE)

(73) Assignee: MHWIRTH GMBH, Erkelenz (DE)

( * ) Notice: Subject to any disclaimer, the term of this patent is extended or adjusted under 35 U.S.C. 154(b) by 249 days.

(21) Appl. No.: 14/236,907

(22) PCT Filed: Jul. 19, 2012

(86) PCT No.: PCT/EP2012/064197

§ 371 (c)(1),
(2), (4) Date: Feb. 4, 2014

(87) PCT Pub. No.: WO2013/017420

PCT Pub. Date: Feb. 7, 2013

(65) Prior Publication Data

US 2014/0157963 A1 Jun. 12, 2014

(30) Foreign Application Priority Data

Aug. 4, 2011 (DE) ..... 10 2011 052 399

(51) Int. Cl.

| | |
|---|---|
| ***E21B 29/00*** | (2006.01) |
| ***E21B 29/12*** | (2006.01) |
| ***E02D 9/04*** | (2006.01) |

(52) U.S. Cl.

CPC ..... *E21B 29/002* (2013.01); *E02D 9/04* (2013.01); *E21B 29/12* (2013.01); *Y10T 83/0467* (2015.04); *Y10T 83/2074* (2015.04)

(58) Field of Classification Search
CPC combination set(s) only.
See application file for complete search history.

(56) References Cited

U.S. PATENT DOCUMENTS

| | | | | |
|---|---|---|---|---|
| 3,338,305 | A * | 8/1967 | Pittman | E21B 29/12 166/298 |
| 4,856,938 | A | 8/1989 | Kuehn | |
| 6,183,165 | B1 | 2/2001 | Heinrichs et al. | |
| 2005/0173123 | A1 | 8/2005 | Lund et al. | |

FOREIGN PATENT DOCUMENTS

| | | | |
|---|---|---|---|
| DE | 42 10 895 | A1 | 10/1993 |
| JP | 4122515 | B2 | 5/2008 |

* cited by examiner

*Primary Examiner* — David Andrews
(74) *Attorney, Agent, or Firm* — Norman B. Thot

(57) ABSTRACT

A method for separating a pipe comprising a pipe axis, a pipe wall, a pipe interior, an inside pipe circumference, an upper end to be separated, and a lower end, the pipe being anchored in the ground by the lower end, includes providing a cutting assembly comprising at least one water jet nozzle which produces a water jet. The cutting assembly is lowered into the pipe interior through the upper end to be separated down to a separation zone. The pipe is cut with the cutting assembly. The cutting assembly acts progressively against the inside pipe circumference. The water jet, when activated, produces a cut comprising a substantially constant cut width and two complementary conical cut surfaces. The water jet is directed at an angle (α) to a plane which runs perpendicular to the pipe axis so that the cut runs diagonally through the pipe wall.

17 Claims, 15 Drawing Sheets

METHOD AND DEVICE FOR SEPARATING PIPES

CROSS REFERENCE TO PRIOR APPLICATIONS

This application is a U.S. National Phase application under 35 U.S.C. §371 of International Application No. PCT/EP2012/064197, filed on Jul. 19, 2012 and which claims benefit to German Patent Application No. 10 2011 052 399.5, filed on Aug. 4, 2011. The International Application was published in German on Feb. 7, 2013 as WO 2013/017420 A1 under PCT Article 21(2).

FIELD

The present invention relates to a method and a device for separating upright pipes of a greater length and greater diameter anchored in the ground at their ends which typically have a length between approximately 30 and 200 m and a diameter of approximately 1800 mm, in particular, anchoring pipes of an offshore oil drilling or production platform. The wall thickness is typically 50 to 100 mm.

BACKGROUND

Depending on the properties of the ocean floor on which the offshore oil drilling or production platforms are situated, the steel anchoring pipes of these platforms are inserted, for example, into the ocean floor by being rammed into place and held there entirely due to friction in the seabed. If this is not enough, an alternative is to introduce underwater concrete or the like into the base of the anchoring pipes thereby created, in which case some of the concrete may escape from the lower end of the pipe into the surrounding ocean floor and form an artificially created foundation anchored in the ocean floor after it hardens, thereby adding the anchoring effect to the effect of the weight of the concrete filling the lower portion of the respective pipe up to a certain height. Regulations that apply to the dismantling of platforms often require the anchoring pipes to be cut off a certain distance below the ocean floor.

Methods and devices for separating upright pipes of a greater length and greater diameter anchored in the ground at their lower ends have previously been described. DE 196 20 756 A1 describes such a method and such a device. A disadvantage of previously-described methods and devices is that they sometimes do not function as reliably as desired under extremely rough ambient conditions (sea water often under high pressure, mixed with drilled-out concrete or the ocean floor) and/or a great effort is required to support and/or secure the pipe that is separated.

SUMMARY

An aspect of the present invention is to provide a method and a device which are improved with regard to these disadvantages.

In an embodiment, the present invention provides a method for separating a pipe comprising a pipe axis, a pipe wall, a pipe interior, an inside pipe circumference, an upper end to be separated, and a lower end, the pipe being anchored in the ground by the lower end, which includes providing a cutting assembly comprising at least one water jet nozzle configured to produce a water jet comprising water. The cutting assembly is lowered into the pipe interior through the upper end to be separated down to a separation zone. The pipe is cut with the cutting assembly. The cutting assembly is configured to act progressively against the inside pipe circumference. The water jet, when activated, is configured to produce a cut comprising a substantially constant cut width and two complementary conical cut surfaces. The water jet is directed at an angle ($\alpha$) to a plane which runs perpendicular to the pipe axis so that the cut runs diagonally through the pipe wall.

BRIEF DESCRIPTION OF THE DRAWINGS

The present invention is described in greater detail below on the basis of embodiments and of the drawings in which.

DETAILED DESCRIPTION

Figure 1:
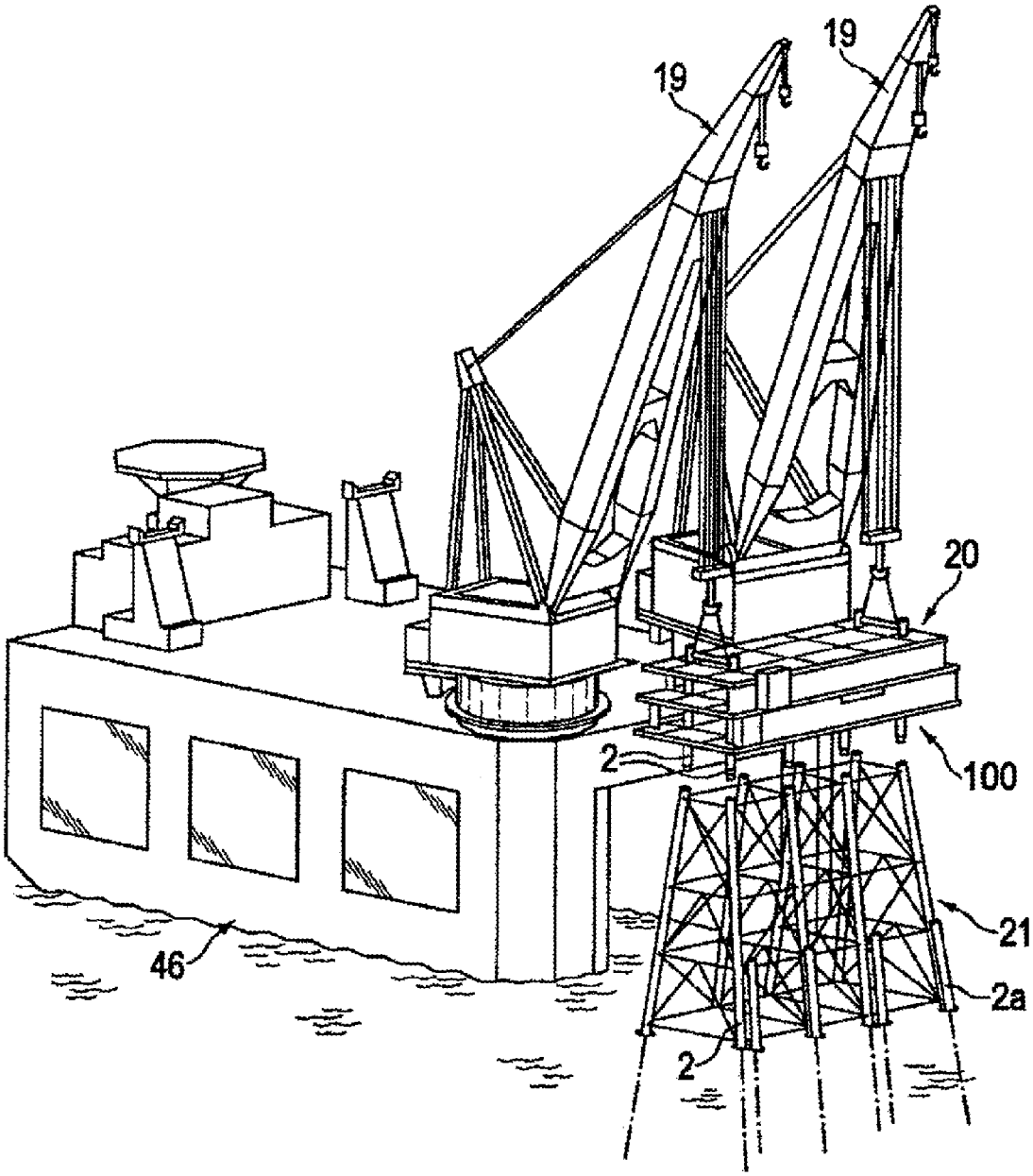
FIG. 1 shows a perspective view of a supporting structure with the production platform raised up therefrom.

With the method according to the present invention for separating upright pipes of a greater length and greater diameter anchored in the ground at their lower ends, in particular anchoring pipes of an offshore oil drilling or production platform, a cutting assembly is lowered into the pipe as far as a separation zone, being lowered through the upper end of the pipe to be separated and advanced as far as a separation zone. The cutting assembly acts progressively against the pipe over the circumference. The separation operation takes place by means of a water jet output by at least one water jet nozzle. The pipe wall is severed by a cut with a cut width that is at least almost constant so as to create two complementary conical cut surfaces, the cut width running diagonally through the pipe wall. To produce the cut running diagonally, the water jet of the at least one water jet nozzle is directed at an angle $\alpha$ which may be between 5° and 60°, for example, to the plane E running perpendicular to the pipe axis A.

Based on the (traveling) cutting axis, this angle $\alpha$ can, for example, remain constant. The term "water jet nozzle" is also used below to refer to multiple water jet nozzles unless otherwise apparent from the context.

The wording "upright pipes" mentioned herein does not necessarily refer to a vertical orientation of the pipes. Pipes which extend upward from the ground at an angle to the vertical are also included.

The water jet cutting is also performed reliably even under rough ambient conditions, in particular when, for example, the pipe wall is severed in one operation because only a very minor rate of advance is then needed, and any rock fragments that may be present will yield without causing any damage.

The separation zone can, for example, be located below the ocean floor.

The angle $\alpha$ can, for example, be 30°.

In an embodiment of the separation process, the weight of the pipe and components optionally connected to it is not secured by additional devices. It has been found that these may be omitted because of the self-centering, conical and complementary cut surfaces. This makes it possible to achieve definite cost savings. The pipe can also be subjected to further loading to a limited extent even after the separation operation because the self-centering effect minimizes the risk of a lateral offset of the pipes in the separation zone and the contact surfaces are thereby reduced to the extent that they no longer withstand the forces also due to corrosion damage.

In an embodiment of the present invention, a plurality of water jet nozzles can, for example, be distributed uniformly over the circumference of the cutting assembly. Two water jet nozzles can, for example, be provided, which can, for example, be arranged diametrically. This accelerates the separation process compared with the use of only a single water jet nozzle while the increased effort remains reasonable.

After a 360° rotation divided by the number of water jet nozzles, the cutting assembly can, for example, be raised and lowered while the water jet is still turned on, resulting in cuts running in the direction of the pipe axis. When there is only a single water jet nozzle, the raising and lowering are, for example, performed after a 360° rotation. When there are two diametrically opposed water jet nozzles, the raising and lowering can, for example, be performed after a 180° rotation. The vertical cuts thus always run in the same location where two cuts meet. The resulting cutting system is capable of compensating for fluctuations in height during the cutting operation, i.e., achieving a reliable separation of the pipe even if the height of the cutting assembly in relation to the pipe varies during the cutting operation.

The cut surface obtained when there are fluctuations in height and comprising one or more discontinuities is referred to as a conical cut surface within the scope of this document.

In order to cement the pipe to improve anchoring in the ground, if some sort of material, such as the ocean floor or concrete, exists in the pipe in the zone where it is to be separated, this material can, for example, be drilled out of the pipe from above in lowering the cutting assembly, namely to a level below the separation zone.

The cutting assembly can, for example, be fixedly connected to the drill string, for example, via a flange connection.

To accelerate the separation process, the inside wall of the pipe can, for example, be cleaned in the area of the separation zone. Concrete or material from the ocean floor which may still adhere to the pipe walls after optionally being drilled out is thus removed. This can, for example, be done by means of rotary drill bits, which may be activatable, if located in the area of the separation zone, or may be constantly in use, i.e., during the entire drilling and/or lowering operation.

The following process steps can, for example, be provided:

- Drilling out the material located inside the pipe such as the ocean floor material or concrete down to a level below the separation zone,
- Raising the drill string by approximately 0.5 m and securing the height of the drill string,
- Deactivating the main hydraulic drive of the drill string and activating an auxiliary hydraulic drive,
- Extracting and positioning of the at least one water jet nozzle,
- Starting operation of the water jet.

The following additional process steps may be performed:

After drilling out the pipe, water lines may be connected along with any electric lines for the drill string, for example, by means of fast-acting connectors. These may not yet be connected during the lowering and/or drilling operations. After starting operation of the water jet, it is possible to wait until a sensor, for example, a hydrophone, detects that the pipe wall has been severed by the water jet. Operation of the auxiliary hydraulic drive may then begin. The rate of advance, i.e., the rotational speed of the auxiliary hydraulic drive, may be increased until the sensor detects a complete cut, it may then be reduced until the sensor detects that the water jet has completely severed the pipe wall. The cutting operation can then be terminated and performed elsewhere (somewhat higher or lower) using the parameters thereby obtained and optimized. All the parameters may be stored.

Abrasive particles can, for example, be added to the water. This separation process is thus a so-called "abrasive jetting" process. The water jet nozzles used for this process are also known as "abrasive water jet cutting nozzles" or simply "AWJ cutting nozzles."

An air blanket comprised of multiple air nozzles can, for example, be created around the water jet. A better performance is thereby achieved.

In an embodiment of the method of the present invention, loose solids can, for example, be transported out of the interior of the pipe during the separation process. It has surprisingly been found that the separation process is thereby accelerated and the quality of the conical cut surfaces is thereby improved. One explanation for this might be that, despite the relatively small cut width achieved during the cutting operation, the quantities of loose solids, e.g., sand between the cut surfaces, may reach the interior of the pipe and have a negative effect on the cutting operation.

Removal of these solids can, for example, take place by using the so-called air-lift method in which air is blown into the interior of the drill string into a hollow drill string which is at least essentially filled with water at a location beneath the water surface, for example, near the location where the transport is to take place. The drill string has a section opening beneath the injection site. Because of the change in density of the water column produced by the injected air, an upward flow is created in the interior of the drill string which entrains loose solids from the surroundings of the section opening into the interior of the drill string and transporting them away.

If the method according to the present invention also comprises the step, for example, of drilling out a pipe filled with concrete, material released during the drilling process, for example, concrete particles, may be conveyed out of the interior of the pipe with the help of the same air-lift method.

In an embodiment, the present invention provides a device for separating upright pipes of a greater length and a greater diameter anchored in the ground at their lower ends, in particular, for severing anchoring pipes of an offshore oil drilling or production platform, where the device comprises a cutting assembly which can be lowered into the pipe through the upper end of the pipe to be separated and advanced as far as a separation zone. The cutting assembly can, for example, act progressively on the inside circumference of the pipe in the circumferential direction in this separation zone which can, for example, narrow axially and thereby sever the pipe. At least one water jet nozzle is provided to achieve the separation operation. Positioning means are provided to facilitate the positioning of the water jet nozzle in relation to the pipe wall so that the water jet output by the water jet nozzle strikes the pipe wall at an angle $\alpha$ to the plane running perpendicular to the pipe axis so that, at separation, two complementary conical cut surfaces are achieved. In this way, even after separation, the pipes are thus in surface contact with one another at these separation faces in the separation zone after separating the pipes. They are self-centering so that the pipe can still absorb forces compressive forces, in particular, to a limited extent, so any securing or support of the separated pipe may be omitted.

The angle $\alpha$ can, for example, be 5° to 60°, for example, approximately 30°. It has been found that this provides sufficient self-centering with acceptable tensile and compressive forces in the circumferential direction in the pipe wall on the cut surfaces, and the cut length increases only to an acceptable extent. The tensile and compressive forces in the circumferential direction are understood to be the forces which result from the conical shape of the cut surfaces and tend to spread one end of the pipe and to compress the adjacent pipe.

Two water jet nozzles can, for example, be provided.

A drill head which can, for example, be arranged beneath the cutting assembly, can be used to drill out the inside cross section of the pipe down to a depth such that the cutting assembly can be brought to bear in the intended cutting zone to remove material located in the lower area of the pipe, such as material from the ocean floor, or concrete, or the like, so that the pipe can be cemented for better anchoring.

The drill head can, for example, be driven to rotate. The cutting assembly can, for example, be fixedly connected to the drill head and/or to the drill pipe.

Rotary drill bits which clean out the inside wall of the pipe to remove concrete or residues of the ocean floor material or the like can, for example, also be provided. These can, for example, be radially pre-stressed. They may be engaged at all times or they may be activatable so that they are used only in the region of the separation zone.

In addition to the main hydraulic drive of the drill pipe, an auxiliary hydraulic drive can, for example, be provided and be used during the separation process which supplies only a low torque, rotates extremely slowly, and which is characterized by a particularly uniform rotational speed. The rotational speed may, for example, amount to one revolution every two hours. This achieves the required uniform and slow advance for the water jet nozzles and thus provides a reliable separation.

The positioning means can, for example, comprise a guide car with guide rollers that can be brought into contact with the inside wall of the pipe. The water jet nozzle can, for example, be fixedly connected at a selected angle to the guide car so that the water jet nozzle is automatically aligned at the correct constant angle to the pipe wall when the guide car is in contact with the pipe wall, and a constant nozzle spacing from the cut surface is also provided.

Extraction mean comprising a pneumatic cylinder and a spring can, for example, be provided. The water jet nozzle is thus, for example, extractable with the guide car and, for example, by a pneumatic cylinder. A retracted position of the water jet nozzle with the guide car is thus provided. This position can, for example, be assumed during the letdown and retrieval of the cutting assembly in the pipe and an extracted position when the cutting assembly is in use.

Multiple air jets can, for example, be provided around the water jet nozzle. By blasting air during the cutting operation, the water jet is separated from the surrounding water, thereby preventing the water jet from being decelerated due to the surrounding water which would thus reduce the efficiency of the device.

As set forth above, two water jet nozzles may be arranged diametrically in the same level. Each nozzle must thus separate only half the circumference. This reduces the cutting time almost in half compared with the use of just a single water jet nozzle. If a larger number of water jet nozzles are distributed uniformly over the circumference, which is also conceivable, the same rule accordingly applies to the number thereof.

In embodiment of the present invention, two water jet nozzles can, for example, be arranged one after the other in the same plane to form a water jet nozzle pair. Each nozzle must cut the full circumference, and the cutting time is twice as long as with two diametrically opposed water jet nozzles. This provides a greater certainty that the full cross section will be completely severed because one of the two water jet nozzles will cut with at least almost the same certainty, even when there are some discontinuities (i.e., irregularities) in the rate of advance.

Multiple water jet nozzle pairs distributed uniformly over the circumference or in diametric opposition can also be provided. In an embodiment of the method according to the present invention, the cutting assembly can, for example, be raised and lowered after a 360° rotation divided by the number of water jet nozzles while the water jet is still turned on. Reference to the number of water jet nozzles is understood to refer to the number of water jet nozzle pairs.

At least one sensor which detects when the water jet passes through the pipe wall can, for example, be provided, for example, a hydrophone. This makes it possible to achieve a reliable and complete separation of the pipe in the shortest possible cutting time.

In an embodiment of the device according to the present invention, means are provided with which loose solids can, for example, be conveyed out of the interior of the pipe during the separation process. The term "loose solids" is understood, for example, to refer to material from the ocean floor which can enter the interior of the pipe between the cut surfaces during the cutting operation and can interfere with the cutting operation there. If a drill head by means of which material in the lower area of the pipe can be drilled out is situated beneath the cutting assembly, this can, for example, include the same means with which the dissolved material can be conveyed out of the pipe during the drilling process.

These means can, for example, be designed so that the solids are conveyed out of the pipe with the help of the air-lift method in which an intake opening communicating with the internal volume of the drill string is provided beneath the cutting assembly on the same drill string on which the cutting assembly is also situated, and an air injection opening which communicates with the inside wall of the drill string is, for example, provided on the drill string above the cutting assembly. An air line which is fixedly connected to the drill string may be connected to the air inlet opening and may also connected to a compressor set up outside the pipe.

The present invention will now be explained in greater detail with reference to exemplary embodiments illustrated in the drawings, in which:

FIG. 1 shows an example of an oil drilling or production platform 100 that has already been separated into its main components, comprising an actual platform 20 which is supported on a supporting structure, labeled as 21 on the whole, in the installed state. All the equipment normally arranged on the actual platform 20, such as the drilling apparatus, accommodations, etc., has already been dismantled and is no longer shown in the drawing. Crane boat 46 having cranes 19 whose height of lift above sea level may be 100 m or more are used for assembling and dismantling the oil drilling or production platforms 100 and/or the supporting structures 21. In the phase illustrated here, the actual platform 20 is already suspended from the cranes 19 after being released from the supporting structure 21. Of the supporting structure 21, FIG. 1 shows only the part above sea level 23 (FIG. 2), which may be 30 meters to 40 meters high. The supporting structure 21 is designed as a tower-type structure having supporting legs 2 and timbered cross struts anchored in the ocean floor beneath the water surface by means of its anchoring pipes 2*a* (indicated with dash-dot lines) extending downward into the water. To this end, the pipes 1 are also filled with concrete in their lower area. The water is usually between 30 and 200 meters deep and can allow each anchoring pipe 2*a* to be inserted, e.g., rammed into the ocean floor, by a comparable distance. The anchoring pipes 2*a* are thus very long, consisting of large pipes 1 with a diameter of, for example, 1800 mm and with a substantial wall thickness of, for example, 80 mm.

Figure 2:
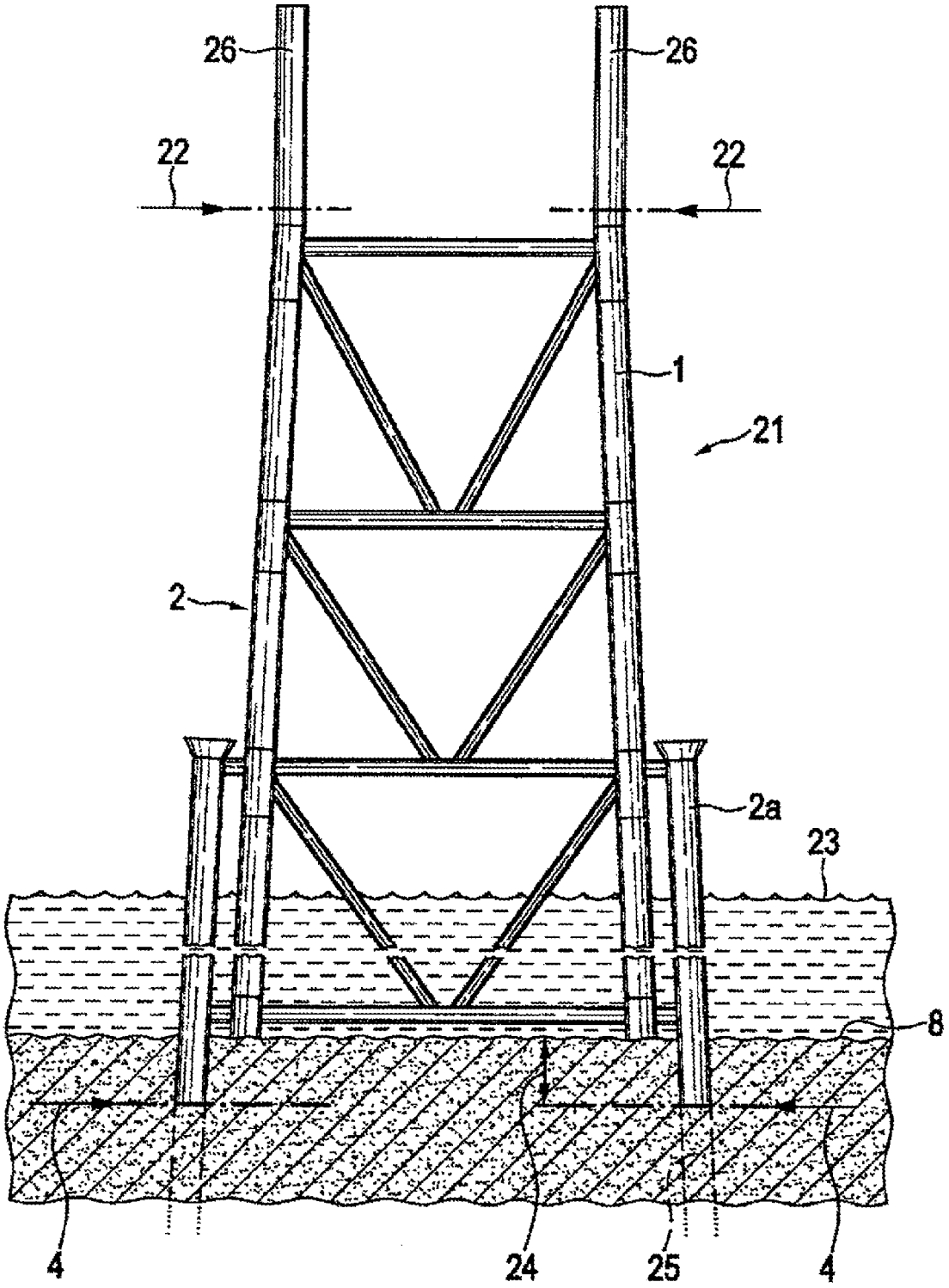
FIG. 2 shows a schematic side view of a supporting structure.

FIG. 2 illustrates the dismantling situation for a supporting structure 21 which deviates structurally somewhat from that in FIG. 1. The upper parts 26 of the supporting legs 2 are cut off at the freely accessible cutoff point/separation site 22 and still belong to the actual platform 20, which is raised by cranes according to FIG. 1. The supporting structure 21 extends above sea level 23 and also extends downward to the ocean floor 8 by a distance which corresponds to the depth of the water. The anchoring pipes 2*a* extend deep into the ocean floor and can be anchored in the ocean floor 8 at their lower ends by underwater concrete, which is pressed into the pipes or a similar foundation-type anchoring. With the object of an oil drilling or production platform 100, it is often required that the anchoring pipes 2*a* are separated from their lower ends 25, which extend deep into the ocean floor 8, at severing locations and/or separation zones 4, which are situated a distance 24 of a few meters below the ocean floor 8. The separation zones 4 are difficult to reach from the outside.

Figure 3:
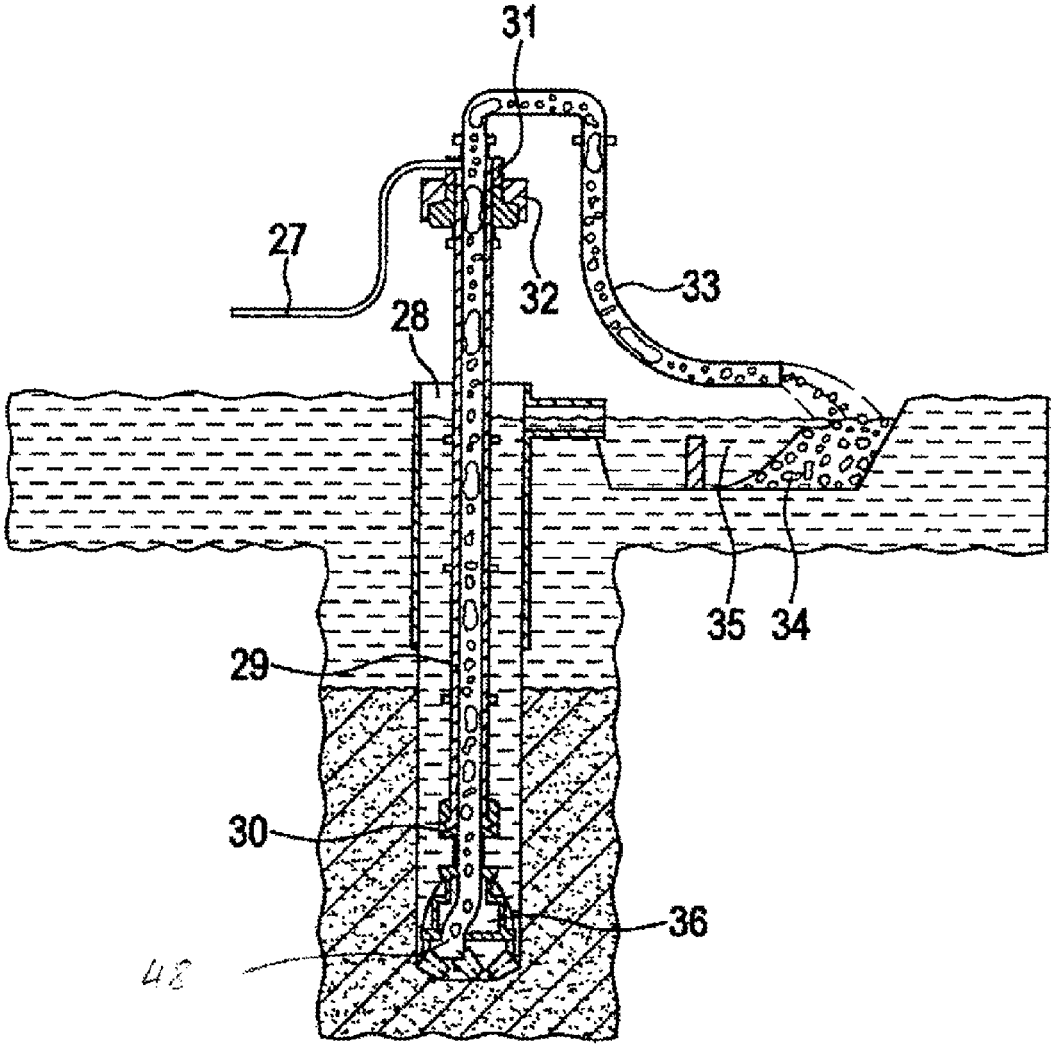
FIG. 3 shows a schematic side view of a drilling operation in the air-lift method.

FIG. 3 shows general information with regard to the so-called air-lift principle. An air-lift pipe and/or drill string 29 is provided, a drill head 36 being arranged at its lower end. This may be for example a rock cutting drill head and/or a rock cutting drill bit. A compressed air line 27 is carried in the drill string 29 at its upper end via an air-lift rinse head 31. The compressed air is sent downward in the drill string to the compressed air inlet valve 30, where it flows through an intake opening 48 into the interior of the drill string 29, where it creates buoyancy with which material from the ocean floor that has been released by the drill head 36 is raised through the interior of the drill string. This clearance of clearing stroke 34 enters a slag pit 35 through an outlet tube 33. A power drive head or a rotary drive 32 is provided on the upper end of the drill string 29. A stand pipe 28 is arranged around the drill string 29.

Since it is difficult to reach the separation zone 4 from the outside, the pipe 1 is severed from the inside. The exemplary embodiment illustrated in the figures relates to the method and the device used when the pipe 1 is filled with concrete 16 or soil or the like to a level above the separation zone 4.

Figure 4:
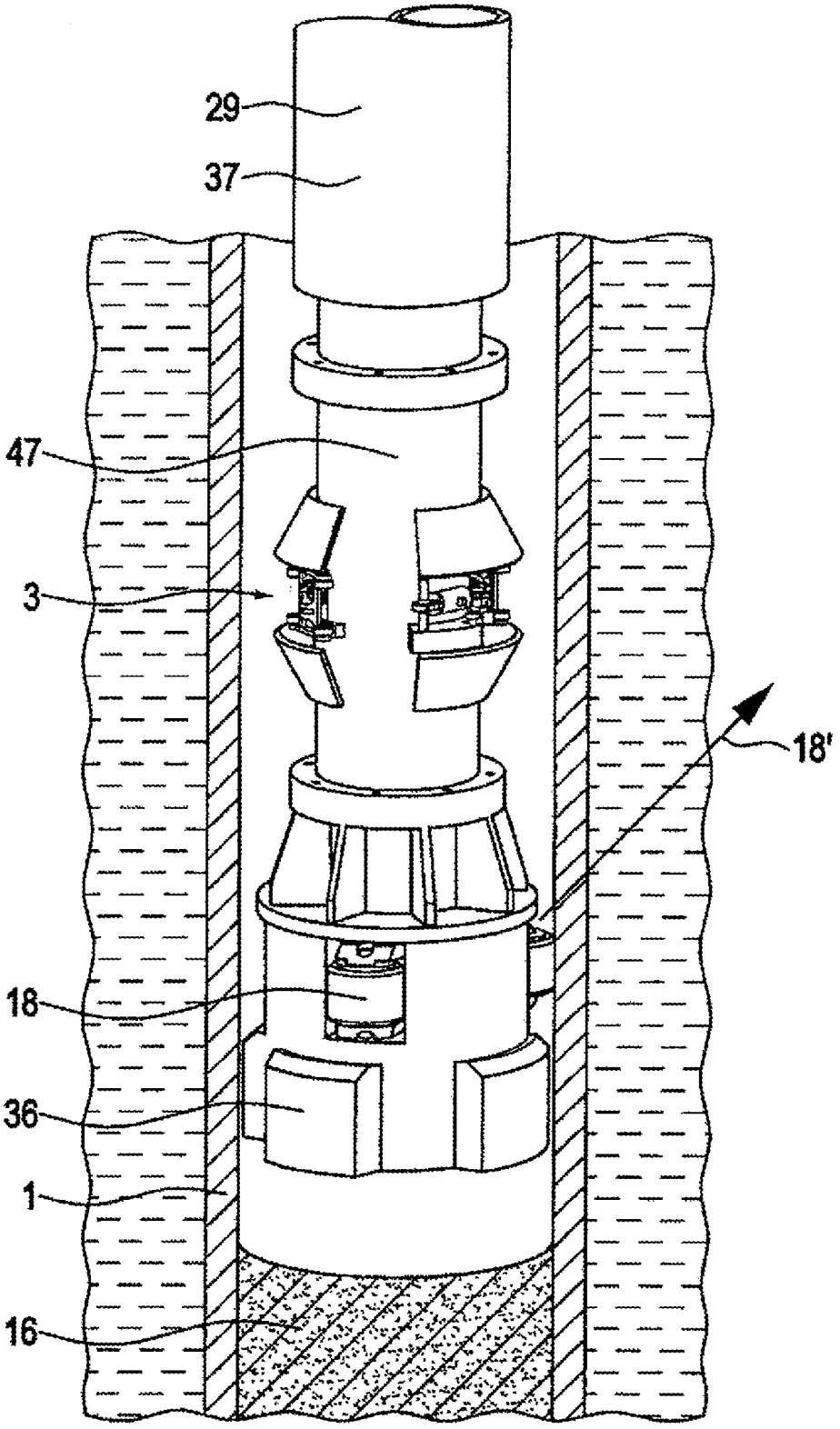
FIG. 4 shows a side view of an drill head according to the present invention with the cutting assembly in the retracted position and arranged fixedly above it.

FIG. 4 shows the drill string 37 which is designed as an air-lift drill pipe and/or drill string 29. A rock cutting drill head and/or a rock cutting drill bit 36 is arranged at its lower end. A cutting assembly adapter and/or a cutting assembly intermediate piece 47 is/are arranged between the drill head 36 and the drill string 37. This cutting assembly adapter and/or cutting assembly intermediate piece 47 is connected by a flange to the drill head and to the drill string. The cutting assembly adapter and/or the cutting assembly intermediate piece 47 may be mountable on a traditional drill string 37 and a traditional drill head. The cutting assembly adapter and/or the cutting assembly intermediate piece 47 comprise (s) the cutting assembly 3.

Figure 5:
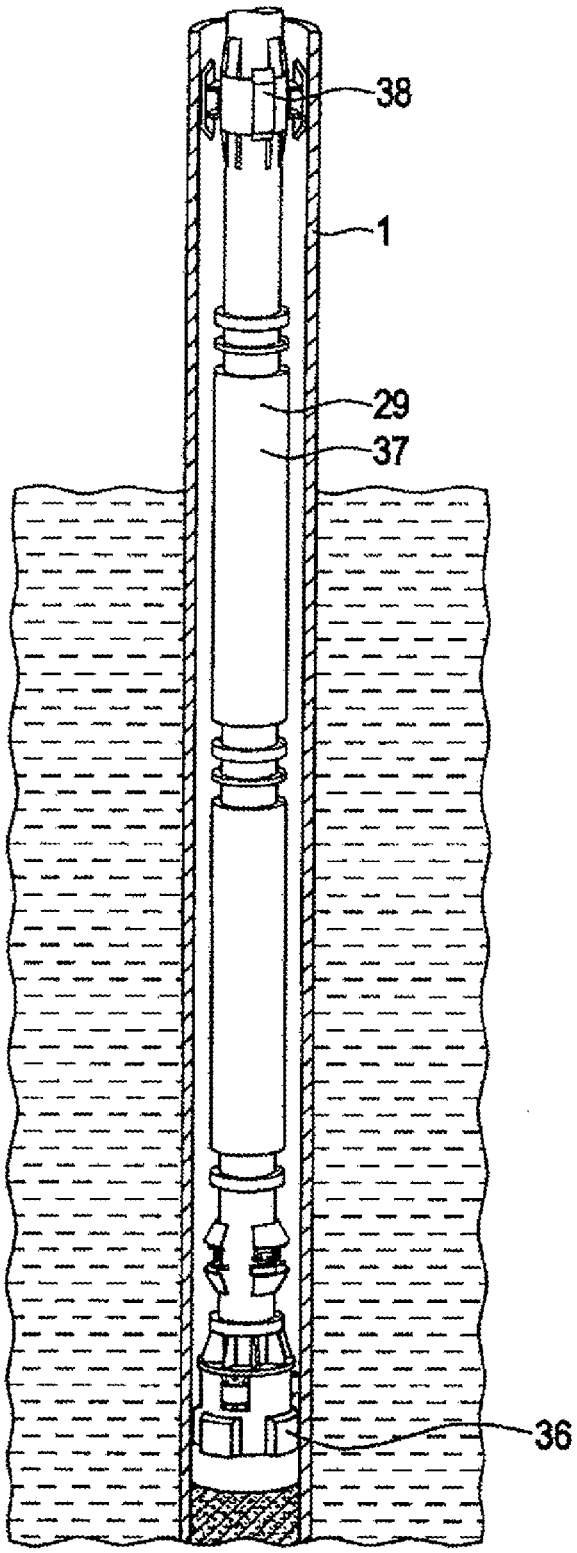
FIG. 5 shows a view as in FIG. 4 in an enlarged detail.

FIG. 5 shows a larger region of the drill string 37. A stabilizer 38 which is supported in the pipe 1 and in which the drill string 37 is mounted rotatably can be seen in the upper region of FIG. 5. A plurality of heavy rods may be provided.

Figure 6:
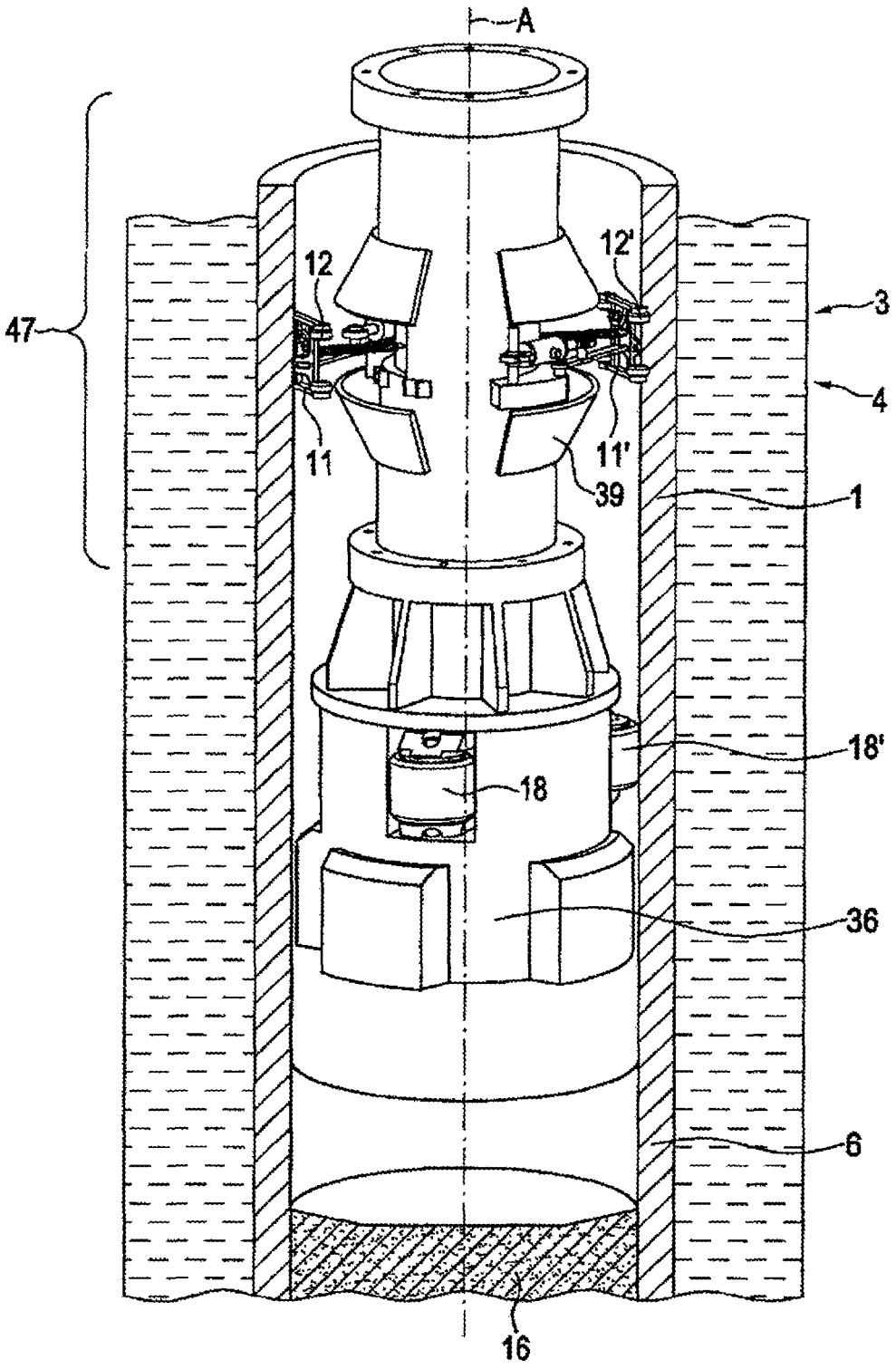
FIG. 6 shows a view as in FIG. 4 with the cutting assembly in an extracted position.
Figure 7:
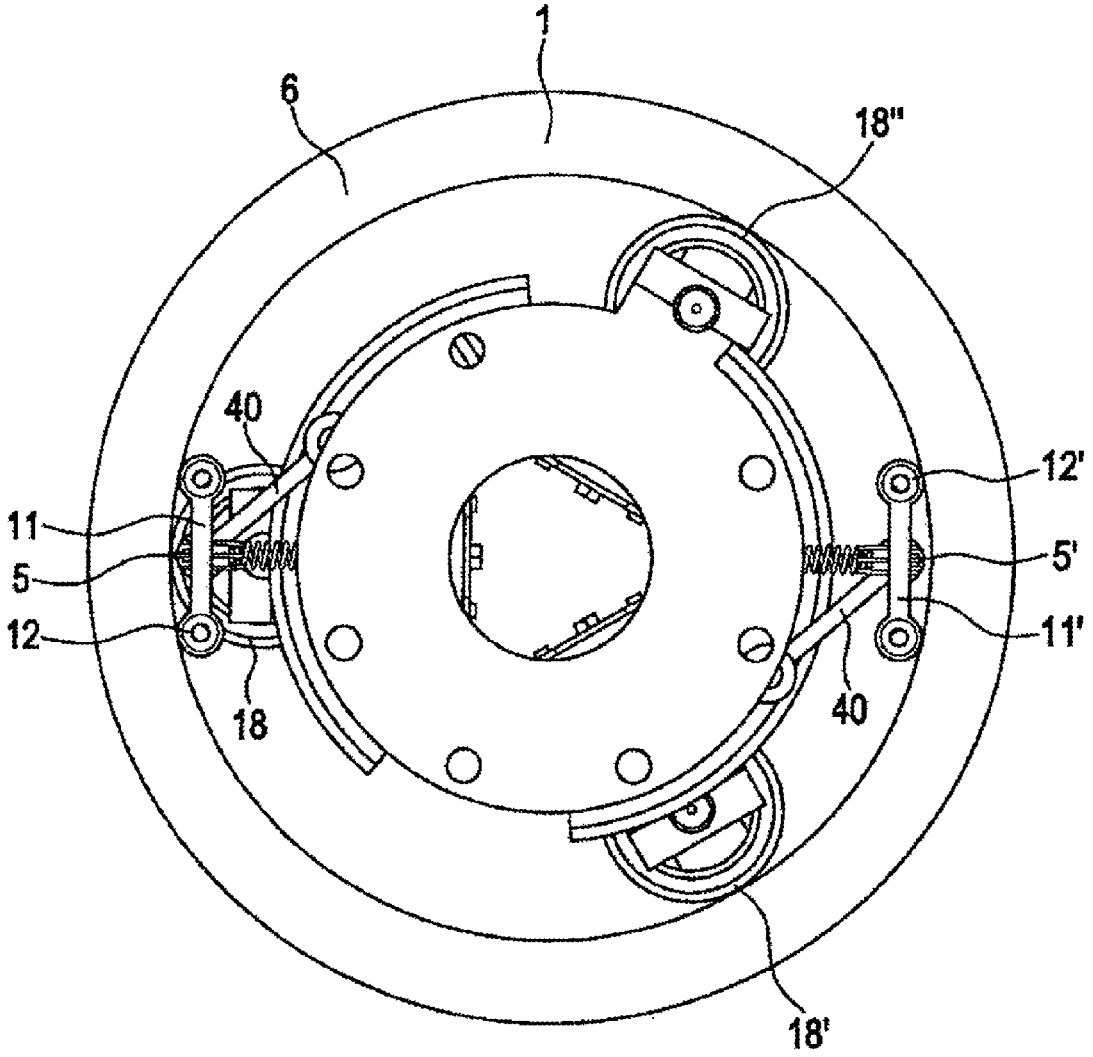
FIG. 7 shows a view as in FIG. 6 with a view in the direction of the pipe axis.
Figure 8:
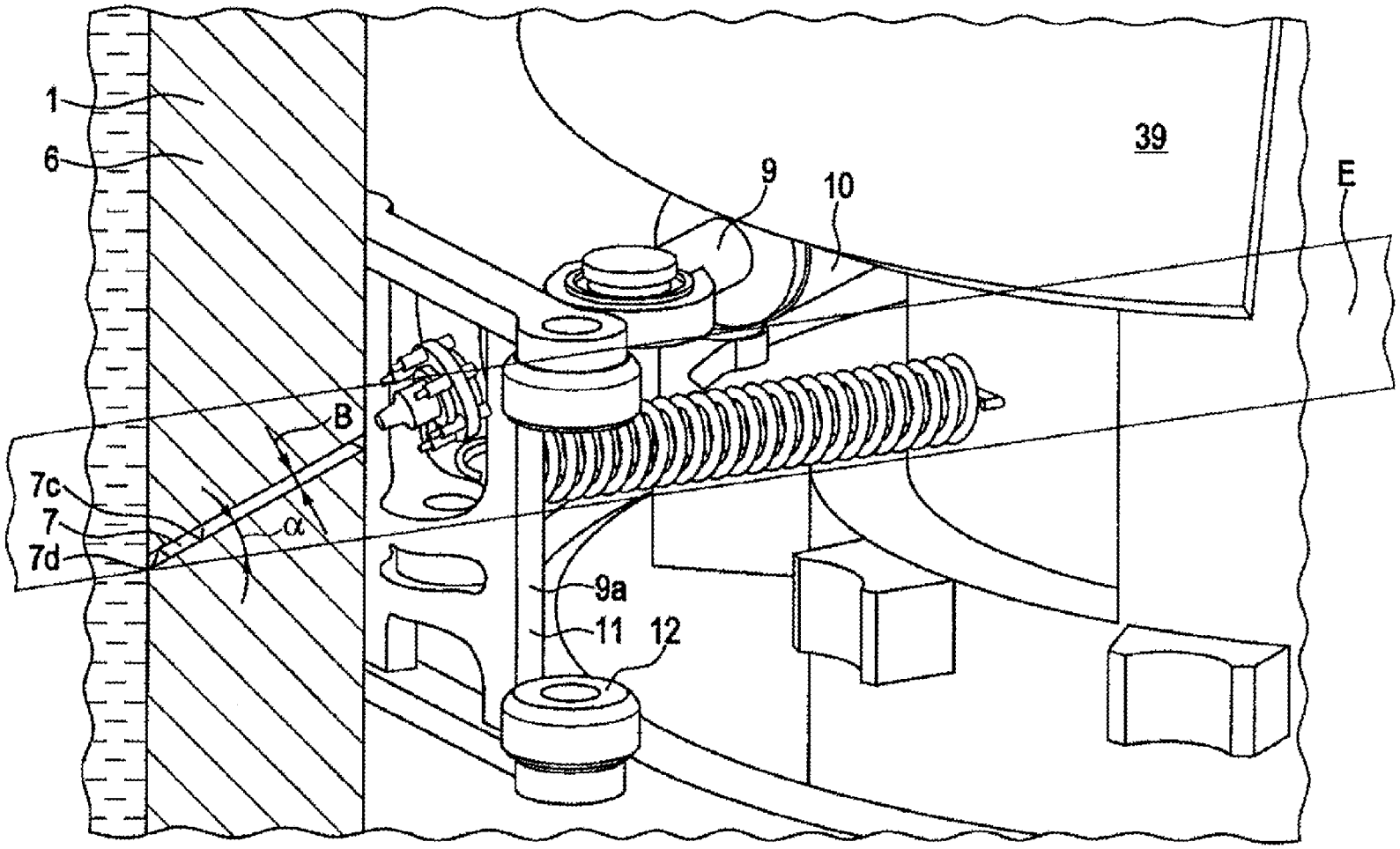
FIG. 8 shows a detail view from FIG. 6.
Figure 9:
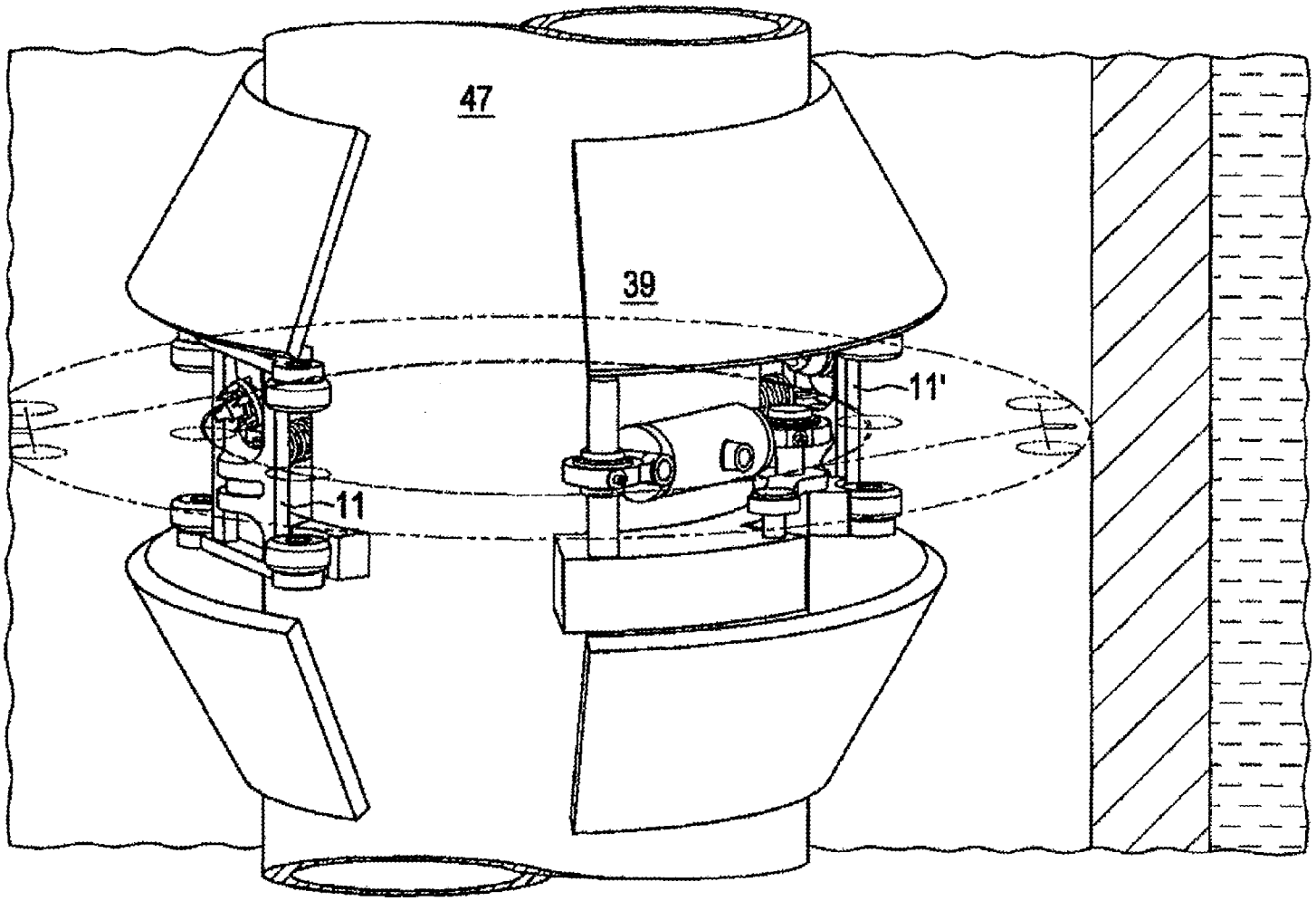
FIG. 9 shows a detail view from FIG. 4.

FIG. 6 shows the cutting assembly 3 in action. The cutting assembly 3 comprises two water jet nozzles 5, 5'. The water jet nozzles 5, 5' are progressively displaceable in the circumferential direction of the pipe 1, in a plane E which is essentially perpendicular to the pipe axis A. The two water jet nozzles 5, 5' are diametrically opposed to one another. It is also conceivable for these water jet nozzles 5, 5' to be arranged directly side-by-side to provide a reliable cutting and to increase the redundancy (not shown in the figures). As shown, for example, in FIG. 12, multiple air jets 14 are arranged around each water jet nozzle 5 (see FIG. 8). The water jet nozzles 5, 5' are each positioned by positioning means 9*a*, comprising a guide car 11, 11' having guide rollers 12, 12'. Each water jet nozzle 5, 5' is thus arranged on a guide car 11, 11', each car guide 11, 11' having four guide rollers 12, 12'. In the extracted position of the water jet nozzles 5, 5', the guide rollers 12, 12' are in contact with the inside wall of the pipe 1. The water jet nozzles 5, 5' are each fixedly mounted on the guide car 11, 11' so that the water jet 15 does not strike the pipe wall 6 parallel to the plane E which runs perpendicular to the pipe axis A. FIG. 9 in particular shows that the water jet nozzle 5 and/or the water jet output by it form(s) an angle $\alpha$ of 30° to this plane E. The same is also true of the other water jet nozzle 5'. The cut width B is small and almost constant. In this way, the complementary conical cutting surfaces 7*c*, 7*d* are created when the guide cars 11, 11' have run completely over the inside circumference of the pipe 1 and the water jets 15 have completely severed the pipe 1. The pipe 1 above the separation zone 4 is thus supported in a self-centering manner on the pipe remaining below the separation zone 4. The pipe 1 therefore need not necessarily be supported or secured.

The water comes out of the water jet nozzles 5, 5' at a very high velocity.

Figure 10:
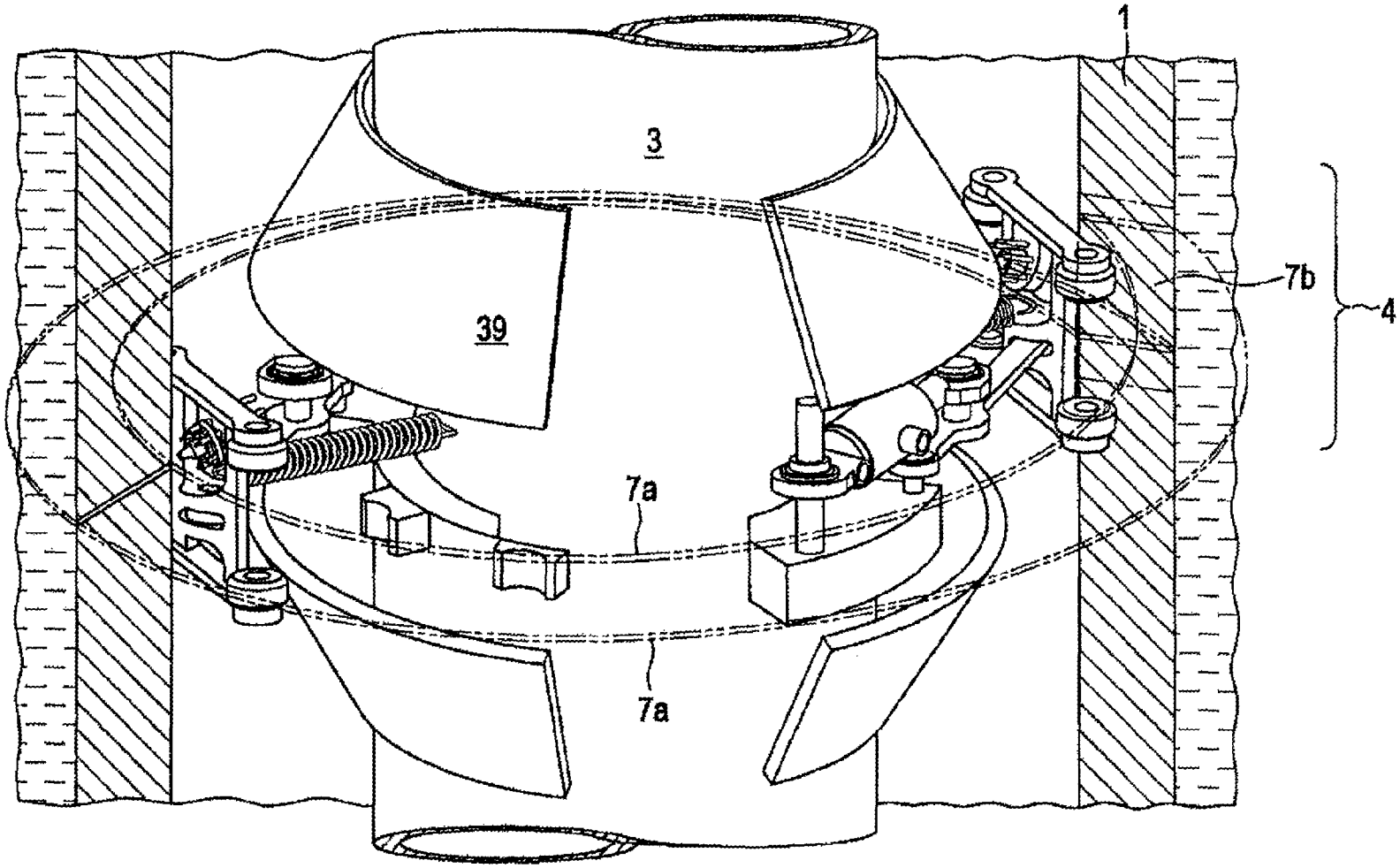
FIG. 10 shows a detail view from FIG. 6 with sectional diagrams.
Figure 11:
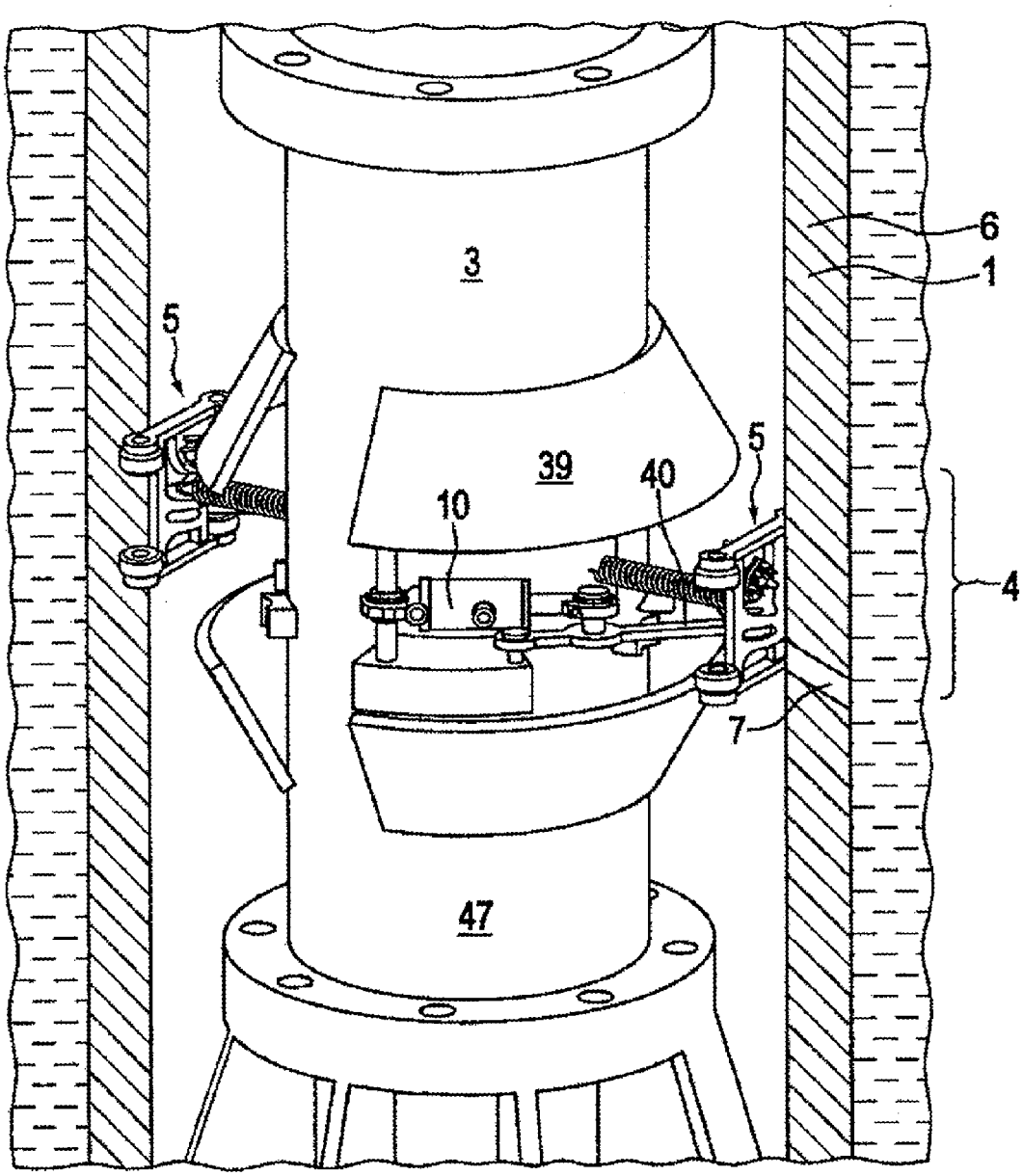
FIG. 11 shows another detail view from FIG. 6 with an altered angle of view.

FIG. 10 shows the sectional diagram 7*a* of the water jets. After both water jet nozzles 5, 5' have together run through the entire inside circumference of the pipe 1, i.e., after a 180° rotation of the cutting assembly 3, the cutting assembly 3 is raised and lowered slightly, resulting in cuts 7 (discernible on only one side in FIG. 10) running in the direction of the pipe axis to compensate for a variation in height of the cutting assembly 3 during the cutting operation, which may last for several hours. The raising and lowering of the cutting assembly while the water jet is turned on is done to such an extent that the pipe 1 is reliably severed even with the anticipated fluctuations in height.

The water jet nozzles 5, 5' and the positioning means 9*a* are extracted from an inserted position into an extracted position by means of extraction means 9. The extraction means 9 comprise an essentially straight pivot arm 40 and a pneumatic cylinder 10. The pivot arm 40 has the guide cars 11 or 11' rotatably mounted on one end. On the opposite end it is rotatably mounted on the other cutting assembly 3. In a central region of the pivot arm 40 which is located closer to the cutting assembly side position than at its other end, the free end of the piston rod of the pneumatic cylinder 10 acts on the pivot arm 40 by way of a rotatable connection. The pneumatic cylinder 10 itself is also rotatably and/or pivotably fastened to the cutting assembly 3.

Figure 12:
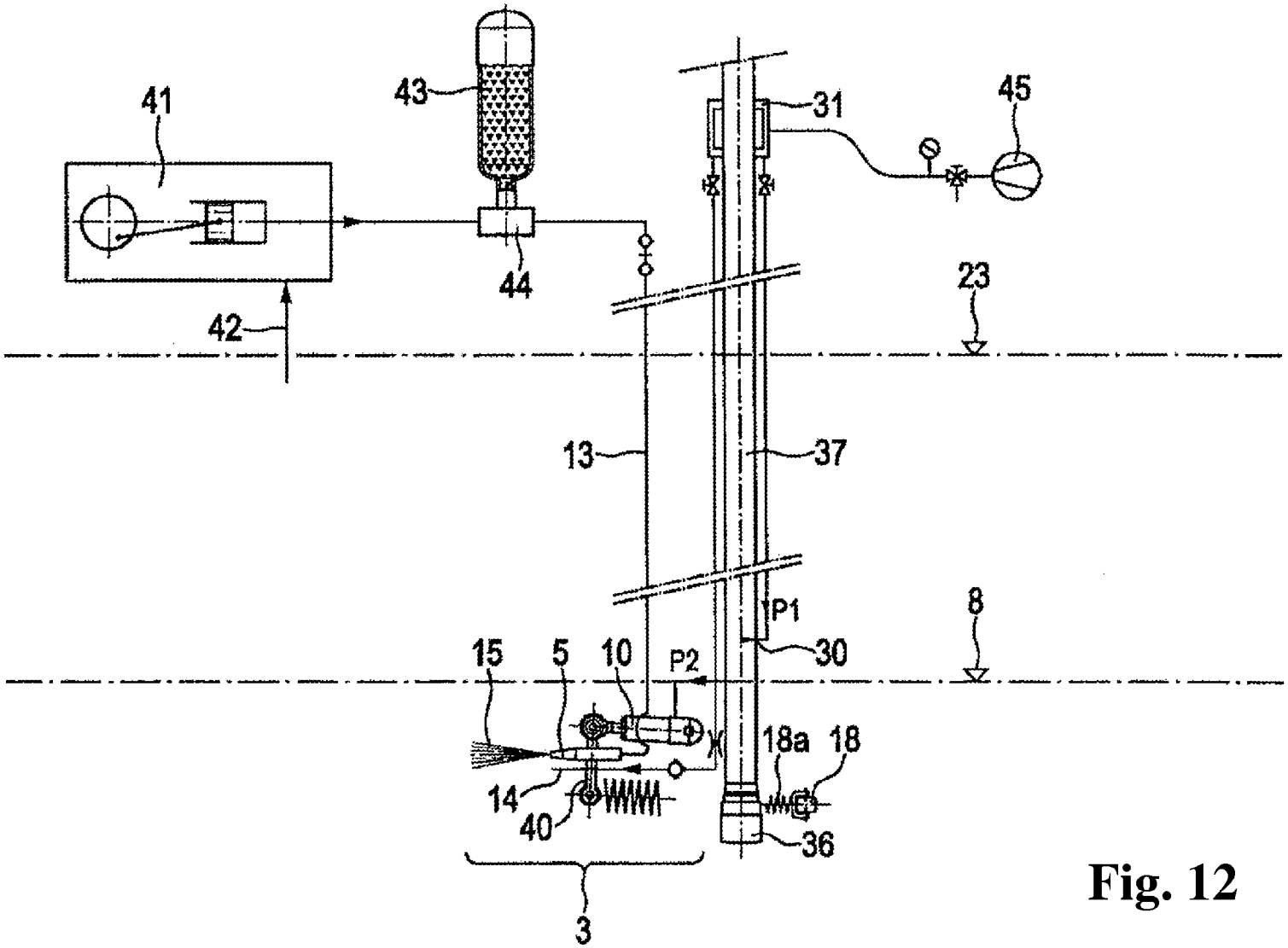
FIG. 12 shows a purely schematic diagram of the method according to the present invention and the device according to the present invention.

As shown in FIG. 6 for example, three additional rotary drill bits 18, 18', 18" are provided on the drill head 36. These drill bits 18, 18', 18" clean the inside wall of the pipe 1 in the region of the separation zone 4 to remove concrete 16 or ocean floor material 8 remaining in this region. The additional rotary drill bits 18, 18', 18" are each pre-stressed by a pneumatic cylinder 18*a* (FIG. 12). A device which cleans an annular region in the separation zone down to the metal of the pipe 1 to remove the adhering material is thus assigned to the cutting assembly 3 and comprises the additional rotary drill bits 18, 18', 18".

Protective plates 39 are provided above and below the water jet nozzles 5, 5' and their extraction means 9 and positioning means 9*a*. These protective plates 39 are rigid and protect the water jet nozzles 5, 5' and the extraction means 9 and positioning means 9*a* in the retracted position of the water jet nozzles 5, 5'.

If the pneumatic cylinder 10 in the retracted position of the water jet nozzles 5, 5' is acted upon by compressed air and is extracted, then it pivots the pivot arm 40 out of a position in which it is in contact with the circumference of the cutting assembly 3 into an extracted position which is spread around the circumference and in which the guide car 11 is in contact with the inside wall of the pipe 1.

FIG. 12 illustrates the device according to the present invention and the method according to the present invention in a highly schematized form. Some of the elements are not shown in their "correct" positions. This shows the drill string 37 at the lower end of which the drill head 36 is provided. An additional rotary drill bit 18 can be seen to the right of this, pre-stressed with a pneumatic cylinder 18*a*. The elements of the cutting assembly 3 are shown at the left of the drill head 36. This shows extraction means 9, comprising the pneumatic cylinder 10 and the pivot arm 40. The guide car 11 is not shown here. A water jet nozzle 5 and a water jet 15 can be seen here. Unlike the diagram in FIG. 12, the water jet 15 here has only an extremely slight widening. The water jet nozzle 5 is connected by a water line 13 to a mixing valve 44 through which abrasive particles 43 are added. This shows the high pressure water pump 41 with the additional water line 42. A compressor 45 can be seen on the other side of the drill string 37. The compressed air line shown on the right side of the drill string leads over the air-lift rinse head 31 to the compressed air inlet valve 30 through which the compressed air for the air-lift method is injected into the drill string 37. Shown on the other side of the drill string 37, the compressed air line leads to the cutting assembly 3, where it splits again into a line leading to the pneumatic cylinder 10 and another line leading to the air nozzles 14.

Figure 13:
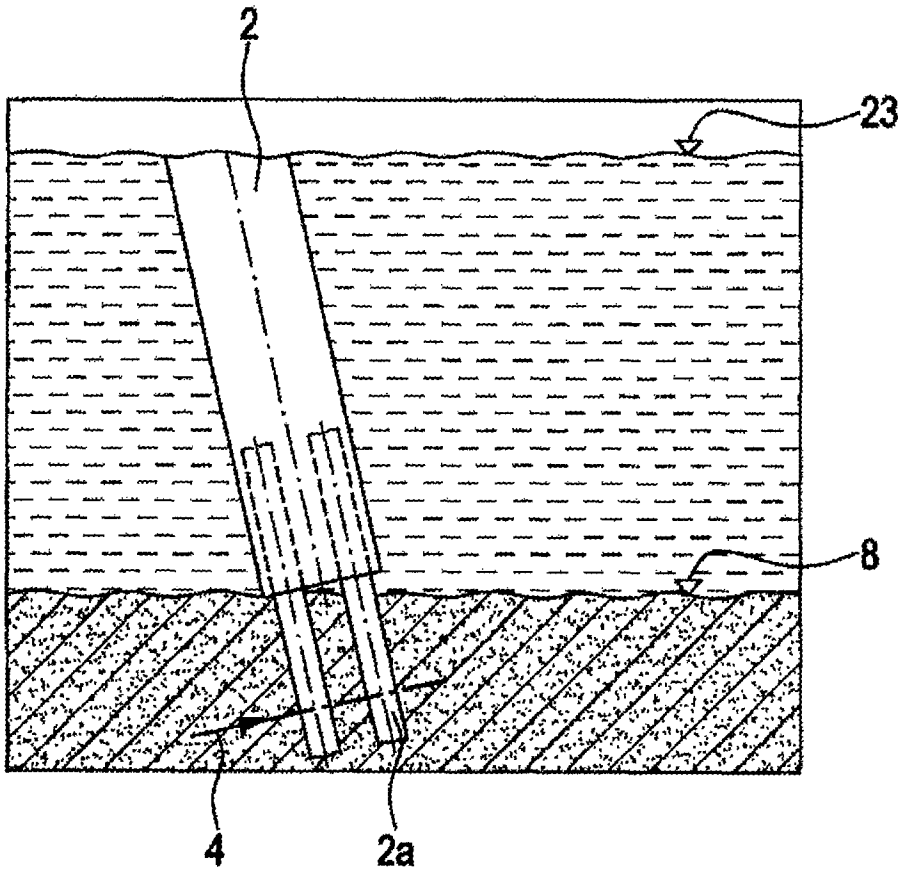
FIG. 13 shows a supporting leg with anchoring pipes.

FIG. 13 shows as an example a supporting leg 2 with anchoring pipes 2*a* to be separated. The separation zone 4 is 6 meters below the ocean floor 8 with a water depth of 140 meters. The anchoring pipes 2*a* are filled with concrete and weighted down. The anchoring pipes 2*a* and the supporting legs are inclined at an angle of approximately 9.5°. The ocean floor consists of compact sand with layers of varying composition (sand and organic sediments).

The method according to the present invention can be carried out under rough conditions such as high winds, high waves and low temperatures. The limiting factor is the dynamic load capacity of the supporting leg 2 with the anchoring pipes 2*a* cut off under rough weather conditions.

Figure 14:
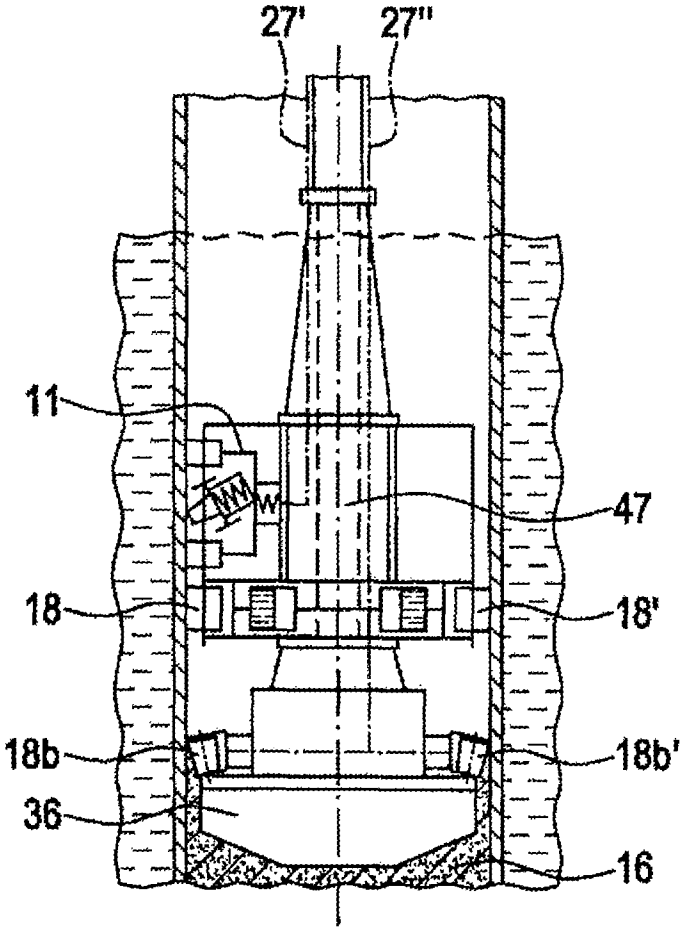
FIG. 14 shows an embodiment of a cutting assembly intermediate piece.

FIG. 14 shows a slightly modified cutting assembly adapter 47. The cutting assembly adapter 47 in this exemplary embodiment has additional rotary drill bits 18, 18', 18". In addition other rotary bits 18*b* are also provided on the drill head 36. Two compressed air lines 27, 27' are shown. One compressed air line 27' causes the guide car 11 to be extracted and produces the air blanket around the water jet. The other compressed air line 27" leads to the additional rotary drill bits 18, 18' and the additional rotary bits 18*b*, 18*b*' and causes them to be extracted at the same time. The functions of the two compressed air lines 27 can be controlled independently of one another.

Another variant of the method according to the present invention will now be explained with reference to FIGS. 15 and 16.

Figure 15:
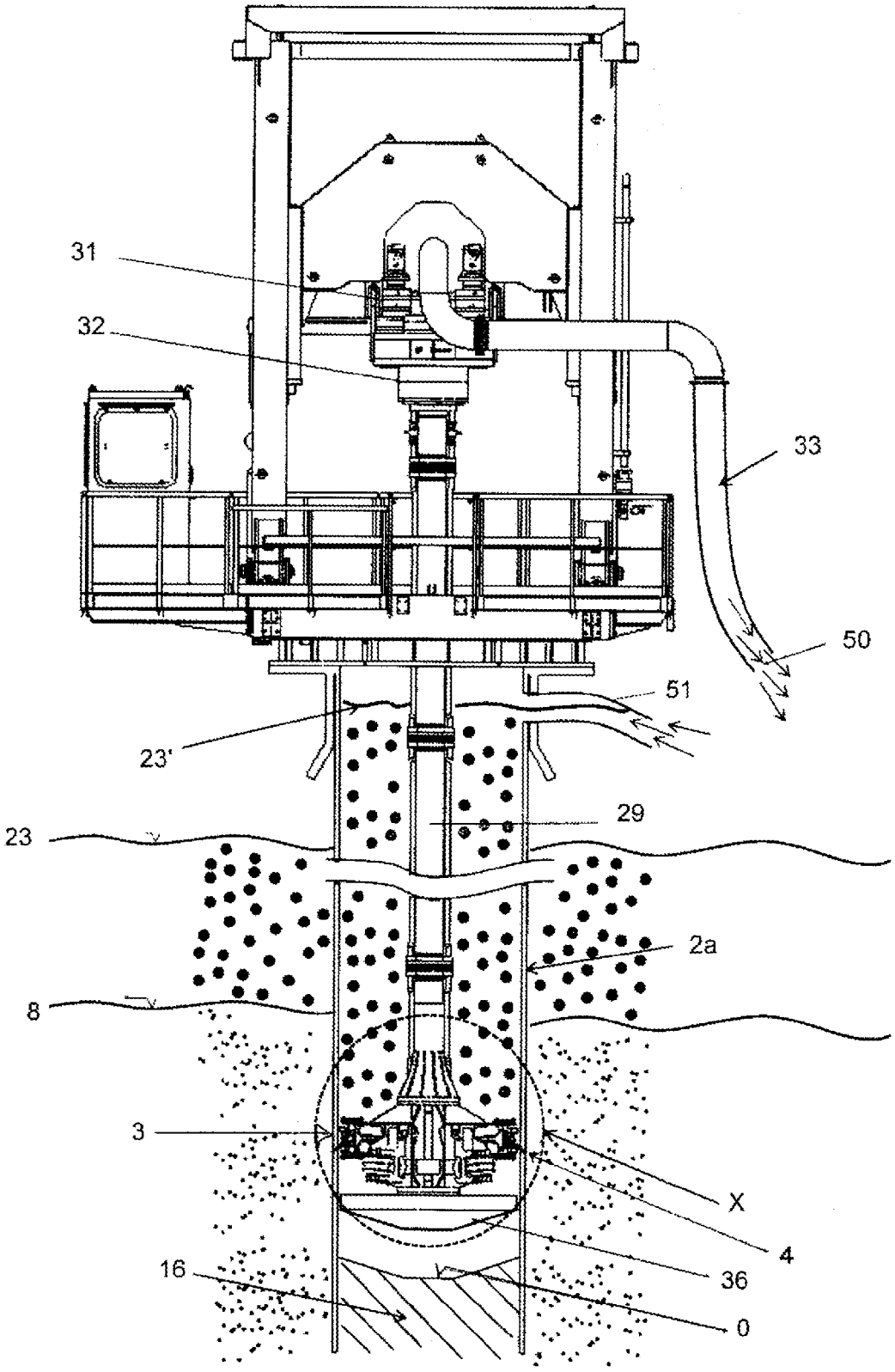
FIG. 15 shows a schematic side view of a device according to the present invention during the separation process.

FIG. 15 shows schematically a device according to the present invention during the separation process. With the help of a drill head 36 situated at the lower end of the air-lift drill string 29, concrete 16 inside the pipe 1 is drilled out down to below the ocean floor 8 and then the air-lift drill string 29 is raised into the position illustrated in FIG. 15 where the cutting assembly 3 is in a position in which the separation zone 4 is still beneath the ocean floor 8 but a clearance remains between the drill head and the surface O of the concrete 16.

Figure 16:
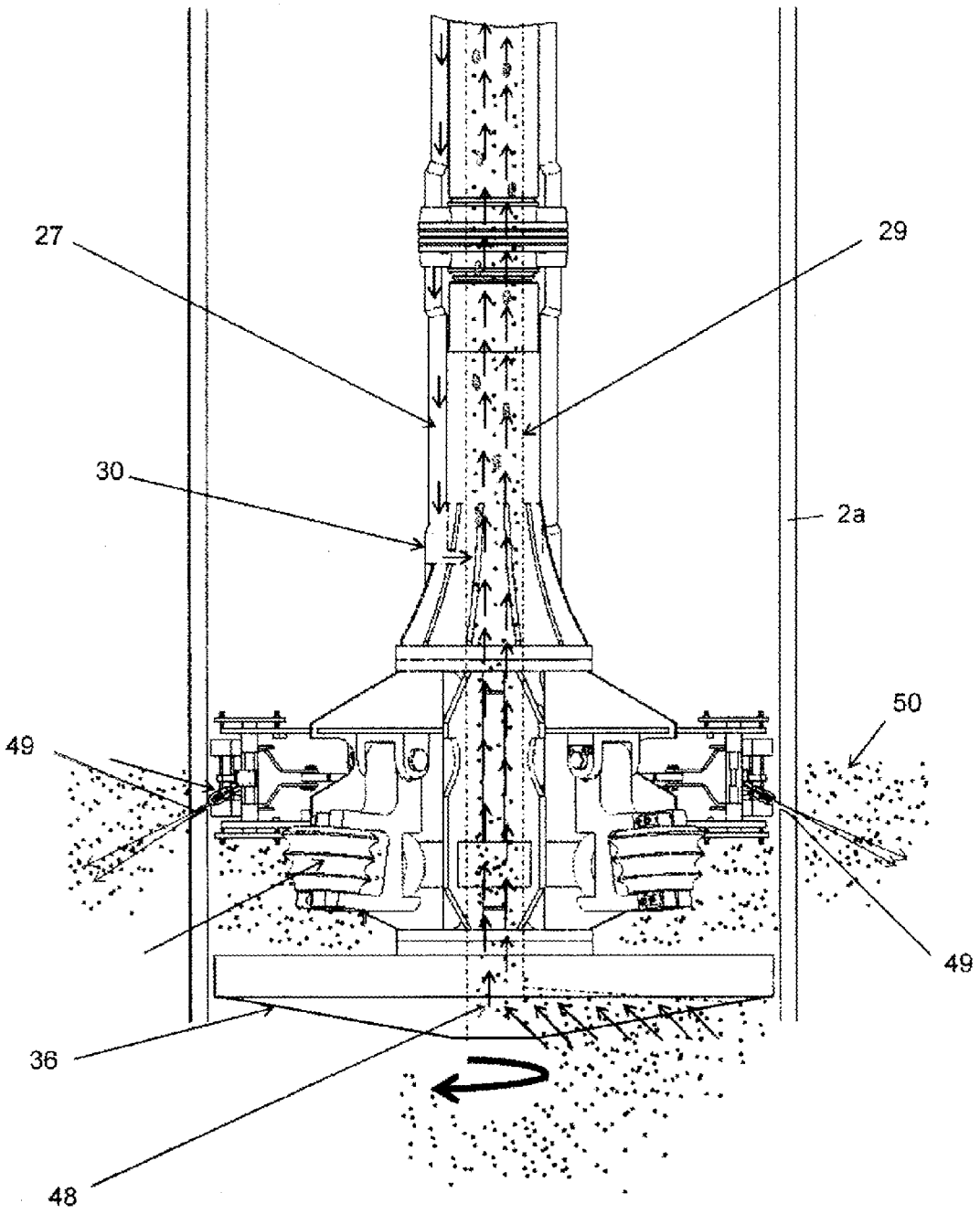
FIG. 16 shows the detail X in FIG. 14 in an enlarged scale.

During the separation process, the air-lift process is continued further by injecting air into the air-lift drill string 29 through the compressed air line 27 and the compressed air inlet valve 30 as illustrated in FIG. 16 in order that loose solids, such as marine sediment 50, that are still present in the anchoring pipe 2*a* during the separation process or that have penetrated through the slots 49 formed during the separation process cannot interfere with or even block the separation process. The air flow is symbolized by the arrows shown in the compressed air line 27. Marine sediment inside the anchoring pipe 2*a* is removed by an upward directed flow thereby created in the interior of the air-lift stream, represented by the arrows pointing up in the diagram. As shown in FIG. 15, water (symbolized by the large dots in FIG. 15) is introduced through an inlet 51 provided above the sea level 23, namely in a volume flow such that the water level 23' inside the supporting pipe 2*a* is consistently above sea level 23.

The present invention is not limited to embodiments described herein; reference should be had to the appended claims.

LIST OF REFERENCE NUMERALS

100 Offshore oil drilling or production platform
1 Pipe
2 Supporting legs
2*a* Anchoring pipes
3 Cutting assembly

4 Separation zone
5, 5' Water jet nozzle
6 Pipe wall
7 Cut, section
7*a* Sectional diagram
7*b* Cuts running in the direction of the axis of the pipe
7*c*, 7*d* Complementary conical cut surfaces
8 Ocean floor
9 Extraction means
9*a* Positioning means
10 Pneumatic cylinder
11, 11' Guide car
12, 12' Guide rollers
13 Water line
14 Air nozzles/air jets
15 Water jet
16 Concrete
17 Free
18, 18', 18" Additional rotary drill bits
18*a* Pneumatic cylinder
18*b* Additional rotary bits
19 Crane
20 Actual platform
21 Supporting structure
22 Freely accessible cutoff point/separation site
23 Sea level
23' Water level
24 Distance (of the separation zone from the ocean floor)
25 Lower ends of the pipes 1
26 Upper parts (of the supporting legs 2)
27, 27', 27" Compressed air lines
28 Stand pipe
29 Air-lift drill string
30 Compressed air inlet valve
31 Air-lift flushing head
32 Power drive head or rotary drive
33 Outlet tube
34 Clearing stroke
35 Slag pit
36 Drill head
37 Drill string
38 Stabilizers
39 Protective plates
40 Pivot arm
41 High pressure water pump
42 Additional water line
43 Abrasive particles
44 Mixing valve
45 Compressor
46 Crane boat
47 Cutting assembly adapter or cutting assembly intermediate piece
48 Intake opening
49 Slots
50 Marine sediment
51 Inlet
A Pipe axis
B Cut width
E Plane perpendicular to pipe axis
α Angle
O Surface

What is claimed is:

1. A method for separating a pipe comprising a pipe axis, a pipe wall, a pipe interior, an inside pipe circumference, an upper end to be separated, and a lower end, the pipe being anchored in the ground by the lower end, the method comprising:

providing a cutting assembly comprising at least one water jet nozzle configured to produce a water jet comprising water;

lowering the cutting assembly into the pipe interior through the upper end to be separated down to a separation zone;

cutting the pipe with the cutting assembly;

rotating the cutting assembly over a rotation of 360° divided by a number of water jet nozzles; and raising and lowering the cutting assembly while the water jet is activated so as to produce cuts which run in a direction of the pipe axis, wherein, the cutting assembly is configured to act progressively against the inside pipe circumference, and the water jet, when activated, is configured to produce a cut comprising a substantially constant cut width and two complementary conical cut surfaces, the water jet being directed at an angle (α) to a plane which runs perpendicular to the pipe axis so that the cut runs diagonally through the pipe wall.

2. The method as recited in claim 1, wherein the pipe comprises a weight, wherein the weight of the pipe is not secured by an additional device.

3. The method as recited in claim 1, further comprising at least one component affixed to the pipe, wherein the at least one component is not secured by an additional device.

4. The method as recited in claim 1, further comprising mixing abrasive particles with the water of the water jet.

5. The method as recited in claim 1, the method further comprising transporting loose solids out of the interior of the pipe.

6. The method as recited in claim 5, wherein the loose solids are transported out of the pipe via an air-lift method.

7. A device for separating a pipe, the pipe comprising a pipe axis, a pipe wall, a pipe interior, an inside pipe circumference, an upper end to be separated, and a lower end, the pipe being anchored in the ground by the lower end, the device comprising a cutting assembly configured to be lowered into the pipe interior through the upper end to be separated to a separation zone so that the cutting assembly acts progressively on the inside pipe circumference in a circumferential pipe direction in the separation zone to produce a separation, the cutting assembly comprising:

at least one water jet nozzle configured to produce a water jet comprising water to produce the separation;

a positioning device configured to position the water jet nozzle with regard to the pipe wall so that the water jet strikes the pipe wall at an angle (α) to a plane which runs perpendicular to the pipe axis, so that, when the separation is complete, two complementary conical cut surfaces are produced; and a plurality of air jets arranged around each of the at least one water jet nozzle.

8. The device as recited in claim 7, wherein the angle (α) is between 5° and 60°.

9. The device as recited in claim 7, further comprising a drill head arranged beneath the cutting assembly, the drill head being configured to drill a material inside the pipe to a depth so that the cutting assembly can be used in the separation zone.

10. The device as recited in claim 7, further comprising rotary drill bits configured to clean out an inside of the pipe wall to remove at least one of concrete and an ocean floor residue.

11. The device as recited in claim 7, wherein two water jet nozzles are provided.

12. The device as recited in claim 11, further comprising a plurality of air jets arranged around each of the two water jet nozzles.

13. The device as recited in claim 7, wherein the positioning device comprises a guide car comprising guide rollers configured to be contacted with the pipe wall.

14. The device as recited in claim 7, further comprising a conveying device configured to convey loose solids out of the pipe interior during the separation.

15. The device as recited in claim 7, further comprising:

a drill string comprising a main hydraulic drive; and an auxiliary hydraulic drive configured to rotate slowly with a uniform rotational speed.

16. The device as recited in claim 15, further comprising:

an intake opening arranged on the drill string, the intake opening being configured to communicate with an interior volume of the drill string, and an air injection opening configured to communicate with the interior volume of the drill string.

17. The device as recited in claim 16, wherein the injection air opening is arranged above the cutting assembly on the drill string.

* * * * *